US005657782A

United States Patent [19]

Berning

[11] Patent Number: 5,657,782

[45] Date of Patent: Aug. 19, 1997

[54] SEPTIC TANK FLUSH

[76] Inventor: Robert D. Berning, 389 N. Liberty Rd., River Falls, Wis. 54022

[21] Appl. No.: 582,362

[22] Filed: Jan. 5, 1996

[51] Int. Cl.[6] ..... B08B 9/08

[52] U.S. Cl. ..... 134/167 R; 134/172; 239/261; 239/264

[58] Field of Search ..... 134/166 R, 167 R, 134/172, 168 R, 169 R; 15/302, 321; 239/261, 264, 251, 265.11; 248/81, 83, 170, 188.7, 169, 171

[56] References Cited

U.S. PATENT DOCUMENTS

| | | | |
|---|---|---|---|
| 721,425 | 2/1903 | Clyde | 248/170 |
| 1,628,141 | 5/1927 | Gray | 134/168 R |
| 2,598,753 | 6/1952 | Bolsey | 248/171 |
| 2,933,093 | 4/1960 | Handyside | 134/168 R |
| 3,392,946 | 7/1968 | Stromberg | 248/171 |
| 4,199,837 | 4/1980 | Frisco, Jr. | 15/302 |
| 4,201,597 | 5/1980 | Armstrong et al. | 134/167 R |
| 4,207,647 | 6/1980 | Masters | 15/302 |
| 4,234,980 | 11/1980 | DiVito et al. | 15/302 |
| 4,322,868 | 4/1982 | Wurster | 15/302 |
| 4,525,277 | 6/1985 | Poulin | 210/601 |
| 5,058,612 | 10/1991 | Winsted | 134/167 R |
| 5,078,799 | 1/1992 | Matter et al. | 134/167 R |
| 5,301,702 | 4/1994 | McKinney | 134/167 R |
| 5,341,539 | 8/1994 | Sheppard et al. | 15/302 |
| 5,352,298 | 10/1994 | Moulder | 134/168 R |
| 5,383,975 | 1/1995 | Faxon | 134/22.11 |
| 5,518,553 | 5/1996 | Moulder | 134/167 R |

FOREIGN PATENT DOCUMENTS

| | | | |
|---|---|---|---|
| 502594 | 4/1976 | U.S.S.R. | 239/265 |

*Primary Examiner*—Frankie L. Stinson

*Attorney, Agent, or Firm*—H. Dennis Kelly; Jeffrey T. Hubbard; Timmons & Kelly

[57] ABSTRACT

A header, a rotating head and a base piece are sequentially mounted on the end of a stand pipe. Water hoses attach to threaded connections in the header. Channels in the header and rotating head supply water from the water hoses to number of passages, that in turn carry water to a number of nozzles located along an outer face of the rotating head. The nozzles are pointed so as to create water jets, which break up material on the floor of a septic tank and generate a torque in the rotating head that turns it about the stand pipe. Spring-loaded legs on the base fold up to allow the apparatus to be inserted through an opening in the septic tank, then extend outward to provide a stable stand. An extension fits over the opening in the septic tank and effectively raises the opening of the septic tank to ground level. A cap covers the extension when not in use.

11 Claims, 2 Drawing Sheets

SEPTIC TANK FLUSH

BACKGROUND OF THE INVENTION

1. Field of the Invention

This invention relates in general to cleaning apparatus for sewers, and in particular to an apparatus for breaking up solidified and semi-solidified sludge in a household septic tank using rotating jets of water.

2. Description of the Related Art

Various devices and methods have been devised for cleaning a septic tank. Most involve truck-mounted, complex equipment that is impractical and prohibitively expensive for the average homeowner. U.S. Pat. No. 4,201,597, issued to Armstrong et al., discloses a device designed to remain within a septic tank. It uses mechanical means to move the device from one end of a septic tank to the other during operation. A television camera, periscope, or other optical system is used to help direct the movement of the device.

Devices have been created that use the action of water shooting at high velocity from a nozzle, both for breaking up solid matter and for propelling the device. U.S. Pat. No. 5,341,539, issued to Sheppard et al., discloses a device having a truncated cone with a plate having numerous orifices across the larger flat face. The smaller flat face is pointed in the direction of travel, and water shooting out of the orifices propels the device along and breaks up solids. The device is designed for pipes and sewer lines, not for cleaning the floor of a tank.

A need remained for a cleaning apparatus that will work in a household septic tank, without being complex or expensive. A device that can operate using water from a municipal water supply was also desired. A device that can be inserted and removed easily from the septic tank was also desired.

SUMMARY OF THE INVENTION

The general object of the invention is to break up solid waste buildup in a septic tank using jets of water. Another object is that the device be easy to insert and remove from the septic tank, to allow for frequent cleaning without excess inconvenience. In concert with a feature of the previous object, a third object is to provide an extension of the septic tank opening, reaching up to ground level, for allowing quick, convenient access to the septic tank.

In general, these objects are achieved by a rotating head that turns against a header having connections for attaching a pair of water hoses. The rotating head has a number of nozzles directed downwardly toward the floor of a septic tank. The head rests on a base that has a number of spring-loaded legs designed to extend away from the base. The header, rotating head, and base all are aligned and connected by a stand pipe that provides means for lowering and raising the apparatus into and out of the septic tank, and helps stabilize the apparatus.

Channels within the header and rotating head direct water supplied by the hoses to the nozzles, where the water is ejected in a collection of water jets. The jets perform the dual functions of breaking up material in the septic tank and generating a torque in the rotating head to turn the head about the stand pipe.

An extension, sized to pass the apparatus, fits over the opening in the septic tank, and raises the effective opening of the septic tank up to ground level. A cap covers the inlet of the extension when not in use, allowing easy access to the septic tank for frequent cleaning.

The above, as well as additional objects, features, and advantages of the invention will become apparent in the following detailed description and in the drawings.

DESCRIPTION OF THE PREFERRED EMBODIMENT

Figure 1:
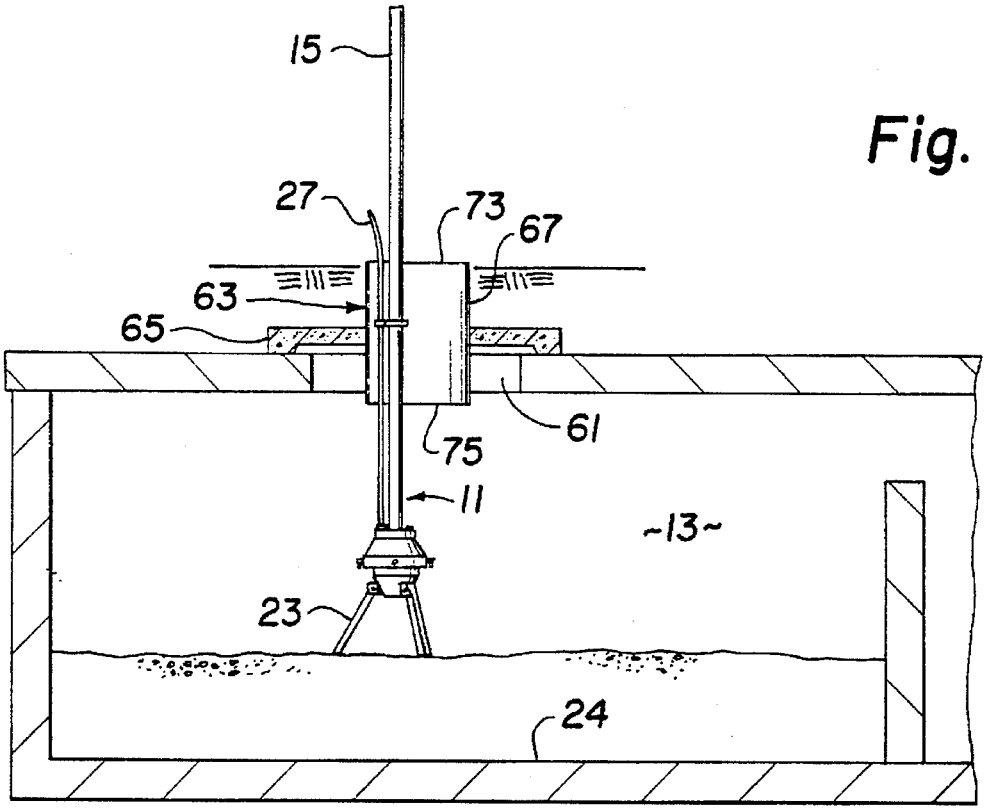
FIG. 1 is a front elevation of a septic tank flush according to the invention, as it appears when inserted into a septic tank.
Figure 2:
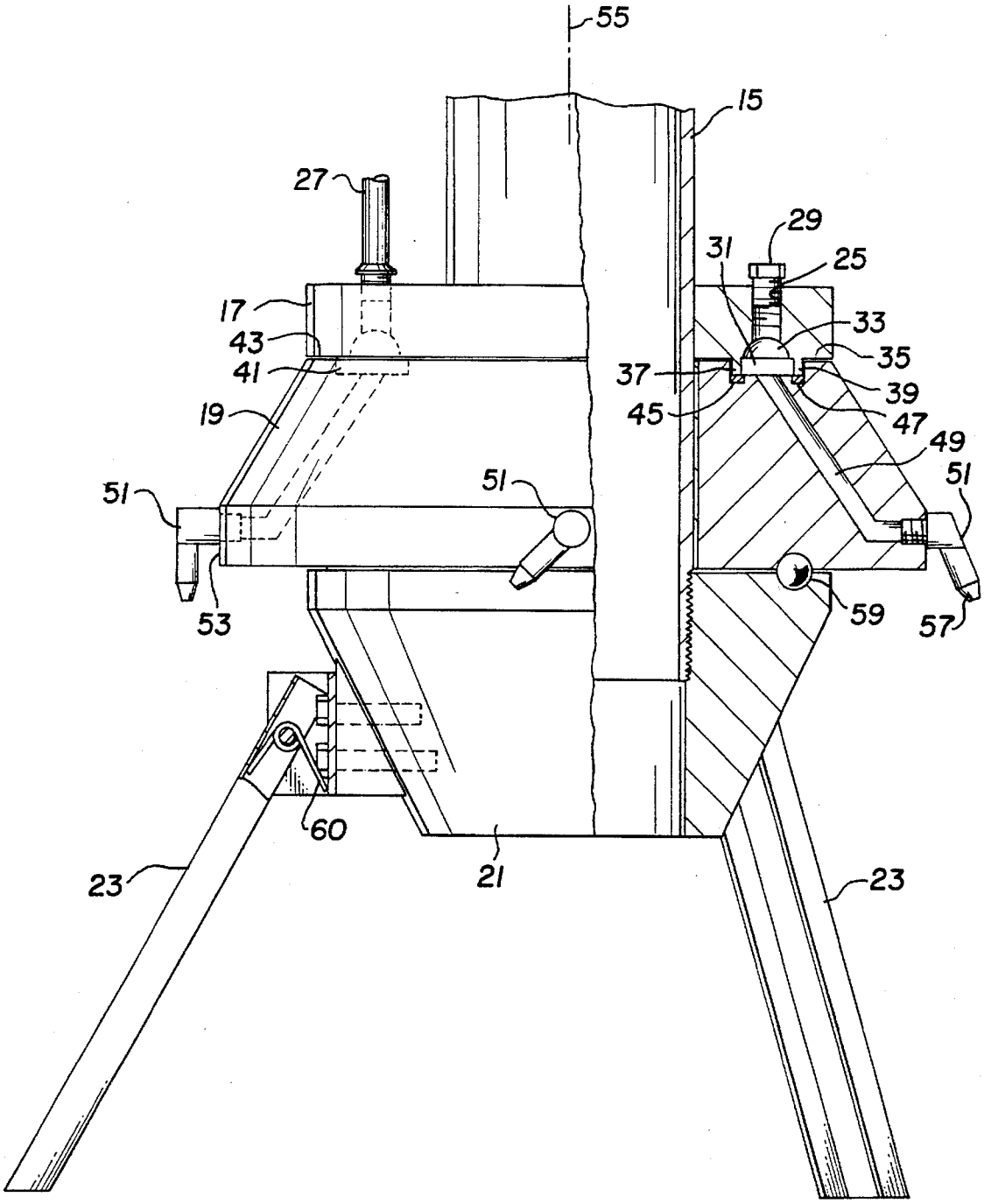
FIG. 2 is an enlarged, partially cross-sectional, front elevation thereof.

FIG. 1 shows the preferred embodiment of the septic tank flush unit 11 of the invention installed in a septic tank 13. As shown in FIG. 2, the flush unit 11 includes a stand pipe 15 that passes through a header 17 and a rotating head 19, and is threaded into a base 21. The stand pipe 15 provides a means for lowering and retrieving the flush unit 11, and helps keep the flush unit 11 upright during operation, as will be described below. The stand pipe 15 is hollow, to allow a vacuum hose (not shown) to pass through the stand pipe 15 down to the floor 24 to draw out sludge as it is flushed from the floor 24 of the septic tank 13. The header 17 is permanently attached to the stand pipe 15 by tack welding, epoxy, or other suitable means. The rotating head 19 rotates around the stand pipe 15. Three legs 23 hold the flush unit 11 up off the floor 24 of the septic tank 13 and make the unit 11 more stable.

The header 17 has a pair of threaded connections 25 that provide the means for connecting a water hose 27 to each connection 25. Each water hose 27 carries water from the local water supply (not shown). A pair of connections 25 is supplied, so that the water hoses 27 can provided adequate water flow. If a single, high capacity water hose 27 is used, one of the connections can be stopped with a plug 29. Water 31 flows through the connections 25 into a ring-shaped channel 33 running along a bottom face 35 of the header 17. A pair of concentric rings 37 and 39 extend away from the bottom face 35, one on either side of the channel 33

The rotating head 19 has a channel 41 defined in its top face 43. The channel 41 is designed to mate with the rings 37 and 39 extending from the header 17. Two gaskets 45 and 47 are inset into the bottom of the channel 41, and form a substantially watertight seal between the rotating head 19 and the header 17. The gaskets 45 and 47 are made of polytetrafluoroethylene or similar material having a low coefficient of friction, to allow the gaskets 45 and 47 to slide easily against the rings 37 and 39 as the rotating head 19 turns.

Passages 49 lead from the channel 41 to nozzles 51 located around the outer face 53 of the rotating head 19. The nozzles 51 direct the water generally downward, toward the floor 24. The nozzles 51 point in different directions to achieve two purposes: to cover the largest practical area during cleaning, and to generate the torque needed to turn the rotating head 19.

The first purpose is achieved by pointing one of the nozzles 51 so that the axis of the nozzle 51 is non-vertical in the plane passing vertically through the axis of rotation 55 of the rotating head 19 and the tip 57 of the nozzle 51. When this is done, the nozzle 51 will spray outward, away from the rotating head 19, cutting a circular path around the unit 11 as the rotating head 19 turns. The more horizontal the nozzle 51 is, the larger is the diameter of the circle cut out by the water jet. Pointing each nozzle 51 at a different angle will result in a series of concentric circles being cut out, which can be spaced to achieve thorough breakup of sludge in the septic tank 13 while covering as large an area as possible. At least one nozzle 51 can be pointed essentially vertically if desired.

The second purpose is achieved by pointing at least one nozzle 51 so that the nozzle 51 points in a direction having a component tangential to the outer face 53, when viewed down from directly above the unit 11. During operation, the reaction force created in the nozzle 51 due to the force of the water (not shown) leaving the nozzle will thus have a component tangential to the outer face 53. This tangential force, located at the nozzle tip 57, thus creates a torque that turns the rotating head 19 in the direction opposite to that in which the nozzle 51 points. The nozzles 51 should be pointed so that the rotating head 19 completes about four to five revolutions per minute during normal operation.

A bearing 59 is located between the head 19 and the base 21 to reduce friction that could prevent the head 19 from turning. A sleeve, bushing, or other device known in the art can be used for this purpose, and may be required to prevent material in the septic tank from entering and clogging the apparatus. Alternatively, the rotating head 19 can be designed to leak water into the bearing 59 to keep the bearing 59 flushed out.

Three legs 23 pivotably attach to the base. A spring 60 biases each leg 23, so that the leg 23 will extend outward from the base 21 when not constrained. The legs 23 are pulled in about the base 21 when inserting the unit 11 in the septic tank 13, to facilitate passing the unit 11 through the opening 61 in the septic tank 13.

Figure 3:
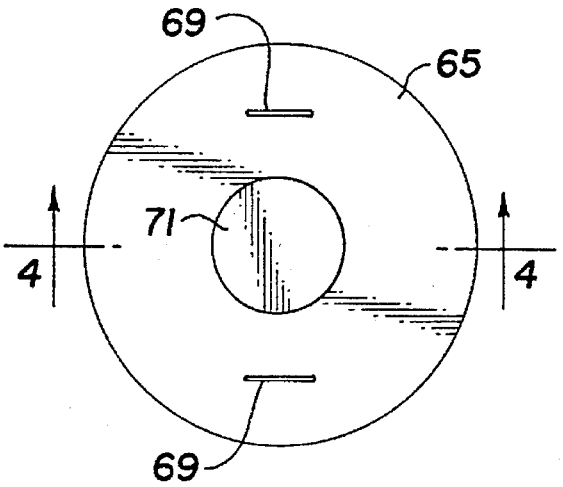
FIG. 3 is a top plan view of a septic tank opening extension, including the cap.
Figure 4:
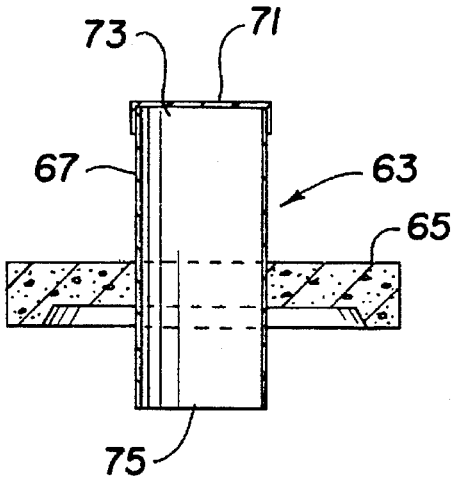
FIG. 4 is a cross-sectional view thereof, as seen along lines 4—4 in FIG. 3.

An extension 63 intended for use with the apparatus 11 is shown in FIGS. 3 and 4. A collar 65, made of concrete, plastic filled with sand, or other heavy material, attaches to a plastic pipe 67 that has about a one foot (305 mm) inside diameter. The collar 65 helps keep the extension 63 firmly planted over the opening 61 in the septic tank 13. The pipe 67 is sized to admit the apparatus 11 when the legs 23 are collapsed. A pair of handles 69 are located on the collar 65 to accommodate lowering the extension 63 onto the septic tank 13. A cap 71 made of cast iron or similarly durable material covers the inlet 73 of the pipe 67 when the apparatus 11 is not in use.

To install the extension 63, a hole is dug to expose the opening 61 in the septic tank. The septic tank opening cap (not shown) is removed, and the extension 63 is lowered into place. When installed, the inlet 73 of the pipe 67 is at about ground level, while the outlet 75 will extend into the septic tank 13. The cap 71 is put on the pipe 67, and the hole is filled in around the pipe 67, leaving the cap 71 exposed. The extension 63 eliminates the need to locate the septic tank 13 and dig a hole to expose the opening 61 for each cleaning.

The septic tank flush of the invention has several advantages over the prior art. The septic tank flush can be constructed simply and inexpensively. It is extremely rugged and durable. It can use the municipal water supply, rather than requiring a special high pressure water source. It has no complicated moving parts, and can be easily installed and removed.

The invention has been shown in only one embodiment. It should be apparent to those skilled in the art that the invention is not so limited, but is susceptible to various changes and modifications without departing from the spirit of the invention.

What is claimed is:

1. An apparatus for cleaning a septic tank, wherein the apparatus comprises:

a stationary header, having a bottom face, a threaded connection for removably attaching a water supply hose to the header, an annular channel formed in the bottom face of the header, for delivering water from the header, and concentric rings surrounding the annular channel;

a rotating head, rotatably interfitting with the annular channel and concentric rings, the rotating head and the stationary header forming a watertight connection; and water ejecting means, attached to the rotating head, for producing a number of generally downwardly directed water jets when the water supply hose supplies water to the apparatus, and for creating a torque, the torque causing the rotating head to rotate.

2. An apparatus as recited in claim 1, further comprising a base, rotatably attached to the rotating head, for holding the rotating head up and off of the floor of the septic tank and for increasing the stability of the apparatus.

3. An apparatus as recited in claim 2, further comprising legs attached to the base, for holding the base up and off of the floor of the septic tank, the legs collapsing together to allow the apparatus to enter through an opening in the septic tank, and then automatically extending outward from the base for increasing the stability of the apparatus.

4. An apparatus as recited in claim 3, further comprising a tubular extension adapted to fit the opening in the septic tank, the extension having a collar, an inlet, and an outlet, for extending the opening in the septic tank, the inlet being located at about ground level when the extension engages the opening in the septic tank, the extension being adapted to allow inserting and removing the apparatus from the septic tank.

5. An apparatus as recited in claim 4, further comprising a cap adapted to fit the inlet of the extension, for covering the extension when the apparatus is removed from the septic tank.

6. An apparatus as recited in claim 1, wherein the head lies in a plane, with an axis of rotation perpendicular to the plane, the head having an outer face radially disposed about the axis, and wherein the water ejecting means is a plurality of nozzles mounted about the outer face and pointing generally downward, at least one of the nozzles being pointed in such a direction that the water jet created by the nozzle produces a torque in the rotating head about the axis of rotation.

7. An apparatus for cleaning a septic tank, wherein the apparatus comprises:

a stationary header, having a bottom face, a threaded connection for removeably attaching a water supply hose, an annular channel formed in the bottom face of the header, and concentric rings surrounding the annular channel;

a rotating head, rotatably interfitting with the annular channel and concentric rings, the rotating head having an axis of rotation and an outer face radially disposed about the axis of rotation, and forming a watertight connection with the stationary header; and a plurality of nozzles, attached to the rotating head, for making a number of generally downwardly directed water jets when the water supply hose supplies water to the apparatus, at least one of the water jets generating a torque, the torque causing the rotating head to rotate.

8. An apparatus as recited in claim 7, further comprising a base, rotatably attached to the rotating head, for holding the rotating head up and off of the floor of the septic tank.

9. An apparatus as recited in claim 8, further comprising legs attached to the base, for holding the base up and off of the floor of the septic tank, the legs collapsing together to allow the apparatus to enter through an opening in the septic tank, and then automatically extending outward from the base for increasing the stability of the apparatus.

10. An apparatus as recited in claim 9, further comprising a tubular extension adapted to fit the opening in the septic tank, the extension having a collar, an inlet, and an outlet, for extending the opening in the septic tank, the inlet being located at about ground level when the extension engages the opening in the septic tank, the extension being adapted to allow inserting and removing the apparatus from the septic tank.

11. An apparatus as recited in claim 10, further comprising a cap adapted to fit the upper opening of the extension, for covering the extension when the apparatus is removed from the septic tank.

* * * * *